US008764430B2

(12) United States Patent
Linossier et al.

(10) Patent No.: US 8,764,430 B2
(45) Date of Patent: Jul. 1, 2014

(54) DEVICE FOR FORMING TABLETS BY CONSTANT VOLUME COMPACTION

(75) Inventors: Max Linossier, Saint Etienne (FR); Jacques Brosse, La Grand Croix (FR); Philippe Eichler, St Just St Rambert (FR)

(73) Assignee: Eurotab, St. Just St. Rambert (FR)

( * ) Notice: Subject to any disclaimer, the term of this patent is extended or adjusted under 35 U.S.C. 154(b) by 642 days.

(21) Appl. No.: 13/054,067

(22) PCT Filed: Jul. 17, 2009

(86) PCT No.: PCT/EP2009/059205
§ 371 (c)(1),
(2), (4) Date: Jan. 13, 2011

(87) PCT Pub. No.: WO2010/007152
PCT Pub. Date: Jan. 21, 2010

(65) Prior Publication Data

US 2011/0142978 A1 Jun. 16, 2011

(30) Foreign Application Priority Data

Jul. 18, 2008 (FR) ..... 08 54917

(51) Int. Cl.
*B28B 5/00* (2006.01)

(52) U.S. Cl.
USPC ..... 425/345; 425/149; 425/DIG. 5; 425/353; 425/354

(58) Field of Classification Search
USPC ..... 425/344–345, 353–354, 149, 135, 425/DIG. 5
See application file for complete search history.

(56) References Cited

U.S. PATENT DOCUMENTS

| | | | | |
|---|---|---|---|---|
| 5,211,964 | A | 5/1993 | Prytherch et al. | |
| 5,698,238 | A * | 12/1997 | Fabbri | 425/345 |
| 2004/0056375 | A1 | 3/2004 | Bubb | |
| 2004/0156940 | A1 * | 8/2004 | Noack | 425/354 |
| 2007/0257411 | A1 | 11/2007 | Romer et al. | |

FOREIGN PATENT DOCUMENTS

| | | | |
|---|---|---|---|
| CH | 103284 | A | 2/1924 |
| CH | 200650 | A | 10/1938 |
| DE | 198 28 004 | A1 | 1/2000 |
| DE | 198 55 328 | A1 | 6/2000 |

(Continued)

*Primary Examiner* — Amjad Abraham
*Assistant Examiner* — Ninh Le
(74) *Attorney, Agent, or Firm* — Blakely Sokoloff Taylor & Zafman

(57) ABSTRACT

The invention relates to a press device for manufacturing tablets from a mixture of at least one component, comprising:

first means (7) for controlling a first punch, the first control means (7) comprising a compaction cam (9) for displacing the first punch (3) into a compaction position, said compaction cam (9) comprising a cam path on which said first punch (3) is capable of being displaced, the cam path comprising a planar portion (90) substantially perpendicular to the axis of the first punch (3), the planar portion (90) extending over an angular section comprised between 5° and 170° for maintaining the first punch (3) in a compaction die (2) at a fixed axial compaction position during a determined compaction maintaining time, second means (7) for controlling a second punch, the second control means (8) also comprising means for maintaining the second punch in said die at a fixed axial compaction position at least during said compaction maintaining time, so as to maintain, during said compaction-maintaining time, the confinement volume (V) at a constant volume corresponding to the compaction volume for forming the tablet.

11 Claims, 4 Drawing Sheets

(56) References Cited

FOREIGN PATENT DOCUMENTS

| | | | |
|---|---|---|---|
| EP | 0 473 458 | A2 | 3/1992 |
| EP | 1 600 285 | A1 | 11/2005 |
| FR | 724379 | | 4/1932 |
| FR | 2 629 712 | | 10/1989 |
| FR | 2927 770 | | 8/2009 |
| FR | 2927770 | A1 | 8/2009 |
| GB | 174657 | | 1/1922 |
| JP | 54-40371 | | 3/1979 |
| JP | 2003-136297 | | 5/2003 |
| SU | 599993 | | 3/1978 |
| WO | WO 00/32386 | | 6/2000 |

* cited by examiner

DEVICE FOR FORMING TABLETS BY CONSTANT VOLUME COMPACTION

This is a non-provisional application claiming the benefit of International application number PTC/EP2009/059205 filed Jul. 17, 2009.

FIELD OF THE INVENTION

The present invention relates to the field of manufacturing of tablets from a mixture of components, notably as powders or granules, and more particularly to a press device for forming such tablets by compaction.

STATE OF THE ART

Existing devices for making tablets by compaction are conventionally rotary presses provided with a central turntable in which a plurality of through-dies are made. On either side and facing each of the dies, lower and upper punches mating each other are positioned, and intended to be inserted into the corresponding die in order to compact the mixture which it contains in order to form a compacted tablet with the desired volume. Indeed, the punches are provided with compaction ends, the surfaces of which define with the walls of the die, a volume for confining the mixture, the punches being gradually brought closer to each other until they attain the compaction volume.

These devices operate according to a cycle which is broken down as follows: after a phase for filling the die with the mixture of compounds, the punches are brought closer to each other in order to gradually apply stress to said mixture before final instantaneous compaction when the punches impose a strong stress on the mixture so as to form a tablet with the desired volume. Once the tablet is formed, it is ejected from the press. In order to perform such a compaction cycle, the use of punches is known, which are guided in a guide rail having a particular profile in order to control axial displacement of the punches, during the filling and ejection phase but also during the phase for bringing the punches closer to each other before the compaction strictly speaking. The axial compaction phase is carried out with compact on rollers on which the punches roll, and which allow the punches to be brought closer to each other instantaneously following a strong stress for forming the tablet to the desired volume.

The applicant has however discovered that it may be interesting in certain applications to maintain the punches in a fixed compaction position so as to compress the mixture at constant volume for a prolonged compaction time. Helpfully, reference will be made to the French patent application filed on Jul. 18, 2008 under the number FR 0854909, for a more complete description of the compaction cycle at constant volume, and of the corresponding applications.

The applicant accordingly sought to develop a rotary press with which such a compaction at constant volume may be achieved. To do this, the punches should be maintained in a fixed compaction position so that the confinement volume (defined by the die and the lower and upper punches) is maintained constant. A solution consists of using a particular compaction unit consisting of compaction rollers and of ball bearings arranged so as to maintain the punches in a fixed axial position, and to thereby prolong compaction. Such a solution is however complex to apply, and it is not very accurate since the axial position of the punches varies significantly with respect to the set position, depending on the contact surface with the roller/bearing. Further, such a solution is not easily adaptable, notably as regards the time for holding the punches.

An object of the present invention is therefore to propose a press adapted for maintaining compaction at constant volume during a determined time, with which at least one of the aforementioned drawbacks may be solved.

In particular, an object of the present invention is to propose a press with which compaction at constant volume may be maintained and which is easily adaptable to any type of product, of rate, and of holding time.

Further another object of the present invention is to propose a press with which compaction at constant volume may be maintained and which may be used at industrial rates, for increased productivity, and this regardless of the type of product to be compacted.

DISCUSSION OF THE INVENTION

For this purpose, a press device is proposed for making tablets from a mixture of at least one component, comprising:

- a turntable in which is arranged at least one die, intended to receive the mixture,
- at least one compaction assembly comprising a first punch and a second punch, said first and second punches being positioned on either side of the turntable facing the die, and mounted so as to be translationally mobile coaxially with the die,
- first control means and second control means for controlling the axial displacement of the first punch and of the second punch respectively, said first and second control means comprising means which co-operate for maintaining the first and second punches in a fixed axial position in which the first and second punches with the die define a confinement volume, characterised in that first control means comprise a compaction cam for displacing the first punch into the compaction position,

- said compaction cam comprising a cam path on which said first punch is able to be moved, the cam path comprising a planar portion substantially perpendicular to the axis of the first punch, the planar portion extending over an angular section comprised between 5° and 170° for maintaining the first punch in the die at a set axial compaction position during a determined time for maintaining compaction,
- the second control means also comprising means for maintaining the second punch in said die in a set axial compaction position at least during said time for maintaining compaction,
- so as to maintain, during said time for maintaining compaction, the confinement volume at a constant volume corresponding to the compaction volume for forming the tablet.

The fact of using a planar cam portion having an angular section comprised between 5° and 170° is particularly advantageous since with this it is possible to compact mixtures for compaction maintaining times comprised between 100 and 2,500 ms, and this within a wide range of speeds of rotation of the press allowing good industrial throughput to be ensured. The fact of being able to compact according to various speeds of rotation gives the possibility of compacting any type of mixture during the indicated compaction times (between 100 and 2,500 ms), including mixtures requiring a reduced speed of rotation of the press (of the order of about ten revolutions per minute).

Further, productivity is all the better since such an angular section for the planar cam portion moreover allows having a press comprising at least two outlets.

The fact that the planar cam portion has a certain length further implies that several punches are simultaneously on the cam path, with which it is possible to further increase the rate of formation of tablets according to a compaction cycle having a compaction maintaining step. Indeed, if several punches are simultaneously on the planar cam portion, this implies that several tablets may be compacted simultaneously on the same planar cam portion with only a slight shift in the compaction cycle.

Preferred but non limiting aspects of the press device above are the following:

- the planar portion of the cam path extends over an angular section comprised between 35° and 90°;
- the cam path of the compaction cam further comprises a pressure rising portion located upstream from the planar compaction-maintaining portion, the pressure rising portion being adapted so as to axially displace the first punch in the direction of an insertion of the first punch into the die, towards the axial position for maintaining compaction;
- the cam path of the compaction cam further comprises a pressure lowering portion located downstream from the planar portion for maintaining compaction, the pressure lowering portion being adapted so as to axially displace the first punch in the direction of a withdrawal of the first punch from the die, from the axial position for maintaining compaction;
- the first punch comprises at least one bearing roller for both allowing rolling of the first punch on the cam path of the compaction cam according to the direction of rotation of the turntable and axial displacement of said first punch;
- the bearing roller is laid out at one end of the first punch coaxially with the axis of said first punch, with a radial axis of rotation relatively to said first punch;
- the first punch further comprises a guiding unit extending radially relatively to said first punch, the first control means comprising at least one guide rail provided with a groove arranged for receiving said guiding unit;
- the guiding unit comprises two rollers laid out on either side of the first punch so as to be able to roll in the grooves laid out on either side of the circular trajectory defined by the displacement of the die;
- the compaction cam comprises at least one stress sensor positioned in a cavity made in the cam for measuring the stresses undergone by the cam path upon the passing of the first punch;
- the compaction cam comprises three stress sensors distributed in three cavities made in the cam, said three cavities being respectively formed at the center and at both ends of the planar portion of the cam path;
- the second control means have a configuration identical with the first control means;
- the second punch has a configuration identical with the first punch;
- the first punch and the second punch respectively correspond to the lower punch and to the upper punch of the press, the first and second control means corresponding to the lower and upper control means respectively.

DESCRIPTION OF THE FIGURES

Other characteristics and advantages of the invention will further become apparent from the description which follows, which is purely illustrative and non-limiting and should be read with reference to the appended drawings, wherein.

DETAILED DESCRIPTION OF THE INVENTION

Figure 1:
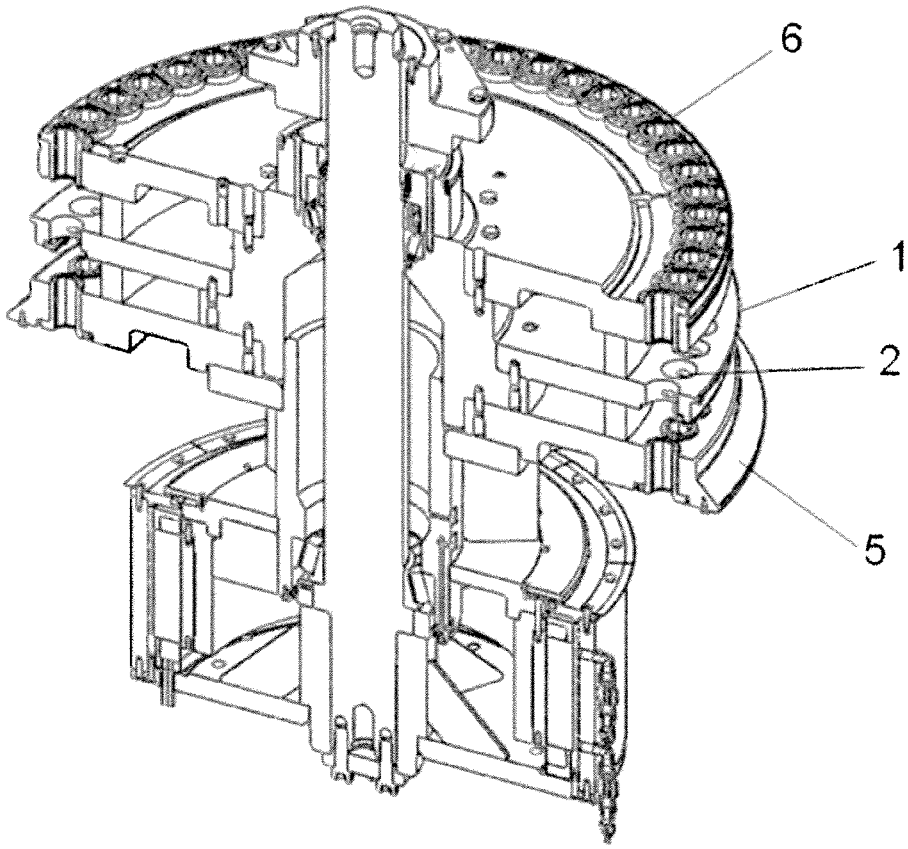
FIG. 1 is a three-dimensional sectional illustration of a rotary press device.
Figure 2:
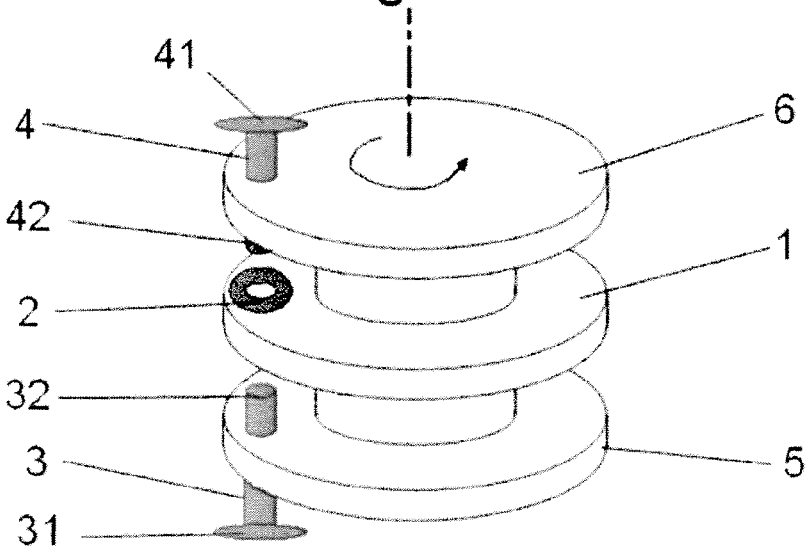
FIG. 2 is a diagram illustrating the driving into rotation of the punches in the rotary press device.
Figure 3:
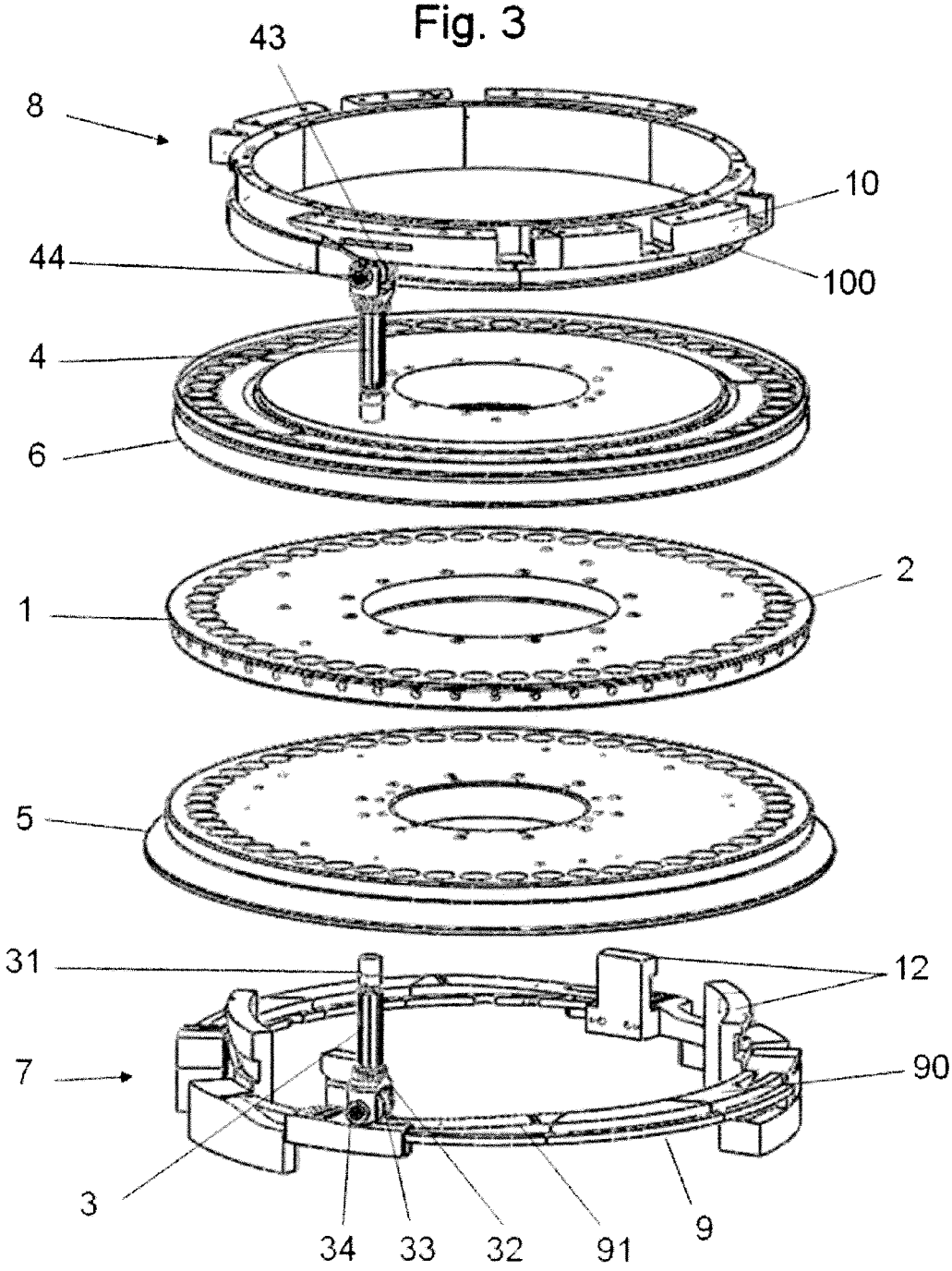
FIG. 3 is a three-dimensional exploded illustration of the press device according to the invention.

FIG. 1 is a perspective sectional view of a rotary press device, with which it is possible to illustrate the structure conventionally used for driving compaction punches according to a rotary movement.

The rotary press device comprises a turret which is set into rotation by the known motorization system via a central driving shaft. The turret comprises a central turntable 1 which comprises at least one compaction die 2, this die 2 being intended to receive a mixture of compounds from which it is desired to form a tablet compacted to a determined volume.

The central turntable preferably comprises a plurality of dies 2 for example distributed at the periphery of the central turntable 1, which has a substantially circular shape. Said dies 2 have a generally cylindrical shape and are either formed by a through-hole directly made at the periphery of the central turntable 1, or each die is a specific part comprising a cylindrical central through-aperture having a circular section with a determined diameter corresponding to the sought diameter for the tablet, this part being used as a die having an external shape adapted so as to be inserted into through-apertures made at the periphery of the central turntable 1.

As indicated above, the press device comprises punches (not shown in FIG. 1) which are laid out on either side of each of the dies 2 of the central turntable 1. Preferably, the device comprises a pair of lower 3 and upper 4 punches for each of the dies 2 of the device. The lower 3 and upper 4 punches are mounted in the press so as to be able to be axially displaced relatively to the corresponding die 2, so that said lower 2 and upper 4 punches may be inserted into the die 2 in order to compress the mixture positioned inside the die so as to form a tablet with a determined volume.

The lower 3 and upper 4 punches are also mounted in the press so as to have a circular movement corresponding to the circular movement of the die 2 with which they are associated. A solution for setting the punches into motion along this circular trajectory is to use driving turntables 5 and 6 located on either side of the central turntable 1, these two driving turntables 5 and 6 being firmly attached to the central turntable 1 and therefore being also rotatably mounted in the press. The driving turntables 5 and 6 are provided with through-apertures positioned at their periphery, these through-apertures being intended to receive the lower 3 and upper 4 punches respectively. The lower 3 and upper 4 punches are therefore driven into rotation by the driving turntables 5 and 6 respectively, in a synchronized way with the corresponding die 2, the lower 3 and upper 4 punches further being able to slide in the apertures provided at the periphery of the driving turntables 5 and 6 so that the compaction ends 31 and 41 of the lower 3 and upper 4 punches may be inserted into the die 2.

The axial displacement of the lower 3 and upper 4 punches is controlled by lower control means 7 and upper control means 8 respectively, these lower 7 and upper 8 control means being intended to co-operate with the guiding ends 32 and 42 of the lower 3 and upper 4 punches respectively. The control means have the purpose of displacing the corresponding punches along the axis of the die so as to modify the axial position of the punch (and more particularly the axial position of the compaction and of the punch) depending on the operating cycle of the press. The axial position of a punch is defined as the position of the punch in the axis of the die, this position thereby allowing characterization of the axial displacement of the punch, but also of the associated confinement volume.

Among the various phases of the operating cycle of the press, there exists a compaction phase during which the lower 3 and upper 4 punches are displaced so as to be inserted into the corresponding die 2 in order to reduce the confinement volume, until a compaction volume is reached which one seeks to maintain constant for a certain time.

The lower 7 and upper 8 control means are adapted so as to co-operate so as to maintain for a determined time, the lower 3 and upper 4 punches in a set axial compaction position in which these lower 3 and upper 4 punches define with the associated die 2 a set confinement volume corresponding to the compaction volume adapted for forming a tablet with a certain volume. To do this, the compaction volume is substantially equal to the sought final volume for the tablet. Preferably, the compaction volume corresponds to the sought final volume for the tablet. However, it may in certain cases be possible that the compaction volume is slightly less than the sought final volume for the tablet; this for example is the case when the compressed compounds in the form of a tablet still have some elasticity.

To do this, one of the two control means comprises a particular compaction cam. In the description which follows, it is considered that the lower control means 7 intended for displacing the lower punches 3, comprise said particular compaction cam. This description is however not limiting since a compaction cam as described hereafter may also be used for the upper control means 8, or even both for the lower 7 and upper 8 control means.

The compaction cam 9 comprises a cam path on which the corresponding punches are capable of moving, this cam path having a trajectory at least partly corresponding to the circular trajectory defined by the movement of the dies 2.

Said compaction cam 9 comprises a planar portion 90 substantially perpendicular to the axis of the punch 3 which moves on the cam. Thus, a punch which moves on this planar cam portion 90 has a set axial position maintained fore determined time. Indeed, the planar portion 90 extends over an angular section which is adapted so as to maintain the punch inserted in the matrix 2 at the desired set position, for maintaining a constant compaction volume for a determined holding time. The angular section of the planar cam portion is defined as the angle formed by the planar cam portion relatively to the center of the circular trajectory of the punches. Moreover the length of the planar cam portion is defined as the distance covered by the punch on said planar cam portion when the punch is driven into rotation by the associated driving turntable.

The dimensioning of the planar cam portion 90, notably as regards its angular section, depends on the time during which it is desired to maintain the compaction volume constant, and on the speed of rotation at which the punches are driven in the press. As mentioned further on, the time for maintaining compaction and constant volume is at least 30 ms (milliseconds). The speeds of rotation for a rotary press used in production are comprised between 18 and 30 rpm, which corresponds to planar cam portions with an angular section of 3.24° and 5.4° respectively, for a compaction-maintaining time at constant volume of 30 ms. If a press is used with a lower speed of rotation, the angular section of the planar cam portion required for maintaining compaction at constant volume during 30 ms is reduced; for example it is 0.36° for a speed of rotation of 2 rpm. The angular section of the planar cam portion will be all the larger since it is desired to maintain compaction at constant volume for a long time (for a given speed of rotation of the press). The compaction cam 9 is adapted and in particular the planar cam portion 90, depending on the time during which it is desired to maintain compaction at constant volume, but also depending on the operating parameters of the press (speed of rotation, diameter, etc). The use of the planar cam portion for maintaining a constant compaction volume is all the more advantageous since it is very simple to adapt and/or install a new cam in the press. Further, the speed of rotation of the press may also be modified so as to attain the desired maintaining time for a planar cam portion having a given length (and therefore a given angular section).

The upper control means 8 are also adapted for maintaining the upper punch 4 in a set axial position while the lower punch 3 is maintained in a set axial position by co-operation with the planar cam portion 90. To do this, the upper control means 8 may comprise a compaction cam 10 having a planar cam portion 100 extending over an angular section at least equal to the angular section of the cam portion 90 of the compaction cam 9. However, any other means with which the axial position of the upper punch 4 may be maintained fixed, may be contemplated. A system of upper punches 4 for which axial displacement is prevented, may for example be used, the upper punches 4 then being maintained in the die 2 at a defined set axial position. It may also be contemplated to have a press device only provided with lower punches 3 intended to be inserted into non-through dies 2, i.e. having an aperture of the "blind hole" type.

The fact that the lower punch 3 moves on the planar cam portion 90 for a determined time (defined both by the angular section on which extends the planar cam portion 90, and by the speed of rotation of the punches) implies that the compaction N31 of the lower punch 3 is maintained in the die 2 at a set axial position for a determined time, the compaction end 41 of the upper punch 4 also being maintained in the die 2 at a set axial position, so that the lower punch 3, the upper punch 4 and the die 2 form a confinement volume maintained fixed for the same determined time, this confinement volume corresponding to the compaction volume adapted for forming the tablet. Preferably, the different units of the press device are adjusted so that the lower 3 and upper 4 punches define with the die 2, during this time for maintaining compaction, a set compaction volume corresponding to the final volume of the tablet.

The guiding end 32 of the lower punch 3 is formed so that said lower punch 3 may move on the compaction cam 9 so as to be able to respond to the compaction stresses for forming the desired tablet. In particular, the punches should be able to withstand the forces induced by the compaction of the mixture, the friction forces should be minimized. The sum of the forces induced by the punches during compaction generates a significant torque at the drive of the turret. The use of standard punches imposes the mounting of a motor with a much larger torque and therefore much greater size, intensities, powers. The friction generated by the assembly of the punches, releases, when they are standard, a significant heat energy and rapid degradation of the cams.

Thus, the use of a guiding end 32 is proposed, comprising a bearing roller 33 laid out so that the lower punch 3 may roll on the cam path of the compaction cam 9 along the partly circular trajectory which it defines. The bearing roller 33 is laid out coaxially with the axis of the lower punch 3 at its guiding end 32, with a radial axis of rotation relatively to the axis of the punch. The use of such a bearing roller 33 allows considerable reduction in the friction due to the displacement of the lower punch 3 on the compaction cam 9, which is particularly advantageous for maintaining significant compaction stresses, typically greater than 1 kN (kilo-newton), during prolonged compaction-maintaining times as compared with conventional rotary press systems. Indeed it is sought to maintain a constant compaction volume for a relatively long time (longer than 30 ms, and preferentially comprised between 100 ms to 2,500 ms relatively to conventional systems which carry out compactions which may be described as instantaneous (of the order of a few milliseconds, generally less than 30 milliseconds).

The bearing roller 33 is dimensioned depending on the force stresses to which the press device is subject. It may therefore be adapted depending on the composition of the mixture to be compacted. The dimensioning of the rollers should allow axial forces to be accepted without degrading the cam surface on which they roll (lifetime compatible with maintenance aspects) while allowing mounting of punches in a sufficient number in order to keep good productivity per turret turn. Thus, for example bearing rollers with a more or less large diameter may be used depending on the stresses to which the press device is subject for compacting a determined mixture. When the force stresses are significant, a solution giving the possibility of not having a too large diameter for the bearing roller, this not being necessarily compatible with the size of the press, consists of using for a punch two bearing rollers (33*a*, 33*b*) put side by side. With such a solution, it is possible to use bearing rollers with smaller diameters for a same force stress, which is therefore particularly advantageous in terms of compactness of the press. For example two bearing rollers (33*a*, 33*b*) put side by side with a diameter of 62 mm, may for example be used instead and in place of a single bearing roller with a diameter of 110 mm.

Figure 6:
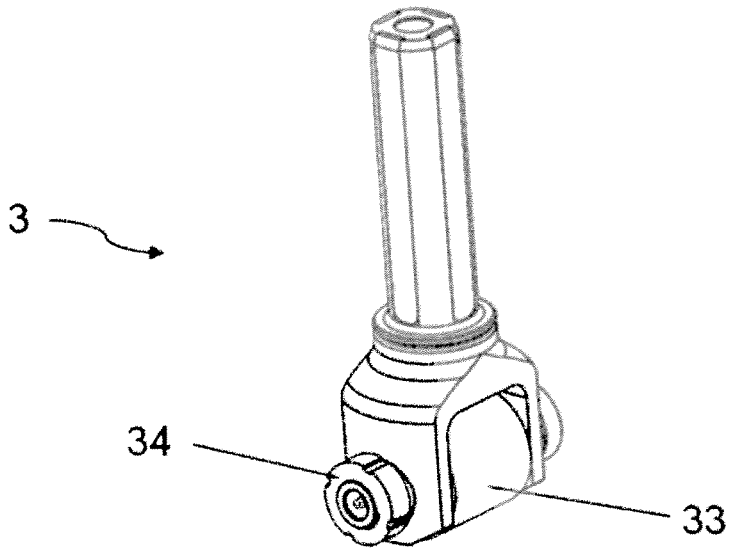
FIG. 6 is a three-dimensional illustration of a punch with a bearing roller according to a particular embodiment of the invention.
Figure 7:
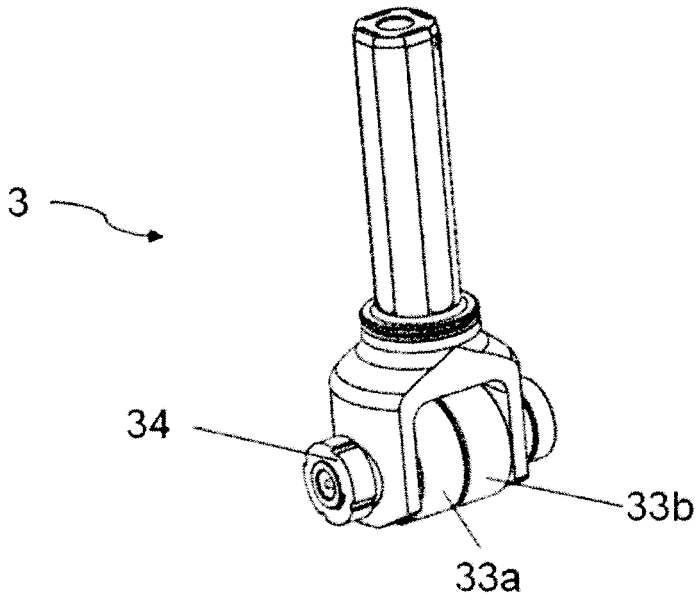
FIG. 7 is a three-dimensional illustration of a punch with a bearing roller according to another embodiment of the invention.

Both solutions, with a single bearing roller and with two bearing rollers, are illustrated in FIGS. 6 and 7 respectively.

In addition to the planar portion 90 corresponding to the compaction-maintaining phase of the compaction phase, the compaction cam 9 may further comprise a pressure rising portion 91 as well as a pressure lowering portion (not shown).

If the direction of rotation of the punches is considered, the pressure rising portion 91 is located upstream from the planar compaction-maintaining portion 90, this pressure rising portion 91 being adapted so as to displace the lower punch 3 in the direction of an insertion into the die 2 until it reaches the axial position corresponding to the set axial position for maintaining compaction defined by the planar compaction-maintaining portion 90.

The pressure rising portion 91 gives the possibility of gradually displacing the lower punch in the die 2, and it is adapted for preparing the mixture for final compaction. The compaction cam 9 may also comprise a pressure lowering portion located downstream from the planar compaction-maintaining portion 90, always with reference to the direction of rotation of the punches in the press device. This pressure lowering portion 92 has the purpose of reducing the compaction volume defined by the lower punch 3, the upper punch 4 and the die 2. Thus, this pressure lowering portion is preferentially laid so as to axially displace the lower punch 3 as well as the upper punch 4 with view to an extraction of the upper compaction end 4 of the die 2.

This pressure lowering portion is however not necessary since the reduction in the confinement volume (defined by the lower punch 3, the upper punch 4 and the die 2) may be carried out by an axial displacement of the upper punch 4 with view to extracting it from the die 2. According to a particular embodiment, the planar compaction-maintaining portion 90 of the compaction cam 9 may be followed by a cam portion 11 laid out for axially displacing the lower punch 3 in order to increase its insertion into the die 2. Such a cam portion 11 may be described as an extraction cam, laid out for expelling out of the die 2 the tablet formed during the compaction phase by the compaction-maintaining cam 90, so as to recover this tablet and to be able to again fill the die 2 with a mixture of compounds before reforming a new tablet.

As this has just been seen, the lower control means 7 may comprise in addition to the compaction cam 9, which allows handling of the axial displacement of the lower punch 3 during the compaction phase strictly speaking, a guiding means allowing axial displacement of the lower punch 3 during other phases of the operating cycle of the press. The extraction cam 11 is a particular example of such additional guiding means, this extraction cam 11 being used for pushing the tablet out of the die 2 during the extraction phase following the compaction phase.

The lower control means may also comprise a metering cam with a particular cam path for displacing the lower punch 3 in an adequate way during the filling of the die with the mixture of compounds. It is arranged upstream from the compaction cam 9 preferably immediately before said compaction cam 9.

The lower control means 7 may also comprise other guiding units for example allowing displacement of the lower punch 3 between the different significant phases of the operating cycle of the press, in order to put the punches in position. For this purpose, it is for example possible to use one or more guide rails 12 arranged along the circular trajectory defined by the displacement of the dies 2, these rails being provided for co-operating with a guiding unit 34 provided at the guiding end 32 of the lower punch 3. The lower punch 3 may for example be provided with guiding rollers 34 laid out coaxially with the axis of said punch with a radial axis of rotation relatively to this punch, both guiding rollers 34 being located on either side of the punch. In this case, the guide rails 12 are provided with a groove in which the guiding rollers 34 may roll. It is the co-operation of these guiding rollers 34 in the grooves which allows axial displacement of the lower punch 3.

Figure 4:
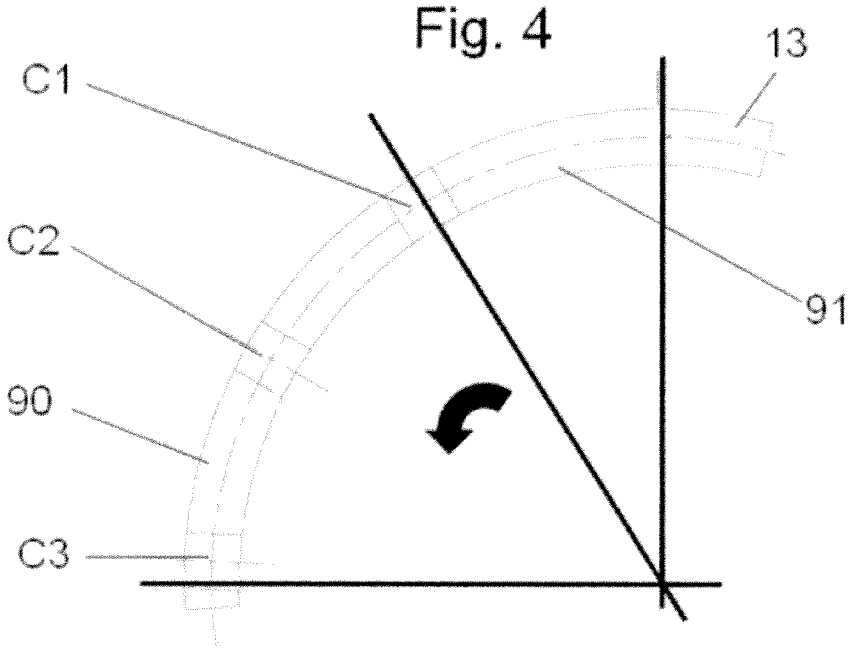
FIG. 4 is a top view illustration of a compaction cam used for the press device.

FIG. 4 illustrates an exemplary cam for the means for controlling the punches. The cam shown as a top view comprises a first cam portion 13 (in the direction of rotation of the punches) corresponding to the metering cam, this metering cam 13 being followed by a pressure rising cam portion 91, and then by the pressure-maintaining cam portion 90. The arrow illustrated in FIG. 4 illustrates the direction of displacement of the punches on the cam.

Figure 5:
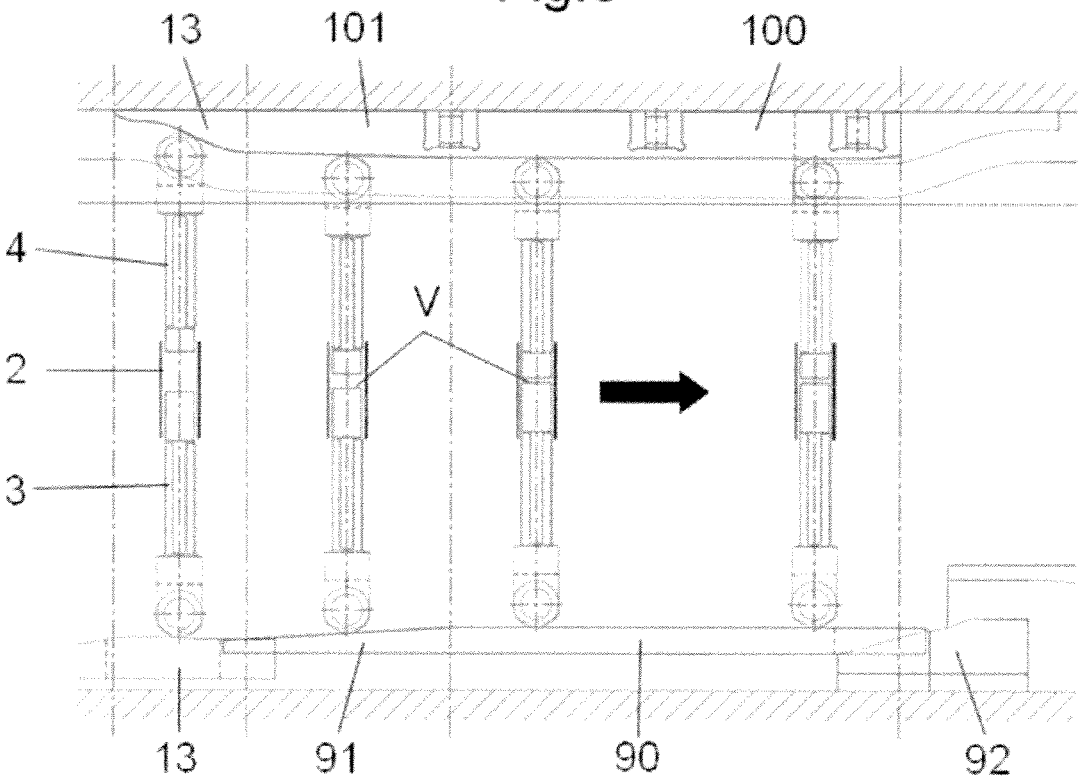
FIG. 5 is a schematic illustration highlighting the positioning of the punches on the associated compaction cams during the compaction phase with a press device according to the invention.

FIG. 5 illustrates a device in which the lower control means 7 comprise cams with portions of cams similar to the cam shown in FIG. 4, i.e. a metering cam portion 13, a pressure rising cam portion (91), and a compaction-maintaining cam portion (90). The upper control means also comprise a planar cam portion (100) for maintaining the punch in position during compaction, this planar cam being also preceded by a pressure rising cam (101). The arrow illustrated in this FIG. 5 illustrates the direction of displacement of the punches on the cams.

FIG. 5 illustrates a particular embodiment of the press device shown in which the lower 7 and upper 8 control means both comprise a planar compaction-maintaining portion, as well as a pressure rising portion. It should be noted that in this particular case, the upper punches 4 have a structure similar to the lower punches and that they in particular preferably comprise at least one bearing roller (43), or even guiding rollers (44). Further, the upper control means 8 are in this particular case provided with adapted means for retaining the upper punches 4 against the effect of gravity.

FIG. 5 further gives the possibility of illustrating the displacement of the lower 3 and upper punches 4 inside the die 2 during their displacement on the cams of the lower 7 and upper 8 control means. It is thereby seen that the confinement volume (V) is gradually reduced when the punches roll on the pressure rising cams (91;101), while the same confinement volume (V) remains fixed (a compaction volume substantially corresponding to the final volume of the tablet) when the punches roll on the compaction-maintaining cams (90; 100).

According to a preferred embodiment, one of the compaction cams at least comprises sensors with which the compaction stress may be tracked, defined by the action of the lower 3 and upper 4 punches on the mixture of compounds to be compressed. Distance sensors may also be provided with which the axial position of the lower 3 and/or upper 4 punches may be tracked.

Making one or more cavities in the planar cam portion may for example be provided in order to insert stress sensors therein with which the stresses undergone by the cam path during the passing of the punch may be measured. This stress may then be directly related to the compaction stress imposed to the mixture of compounds.

In FIGS. 4 and 5, a possible positioning of three stress sensors (C1; C2; C3) in the compaction cams is illustrated. In this particular example they are laid out at the beginning and at the end of the compaction-maintaining phase as well as in the middle of this phase. The more there are sensors laid out in the compaction cam and the more accurate will be the tracking of the compaction at constant volume.

The use of these stress sensors, notably stress sensors placed in the compaction-maintaining cam portion 90 is particularly advantageous for tracking the behavior of the mixture of compounds when it is compacted to a constant volume for a determined time. As this is mentioned later on, these stress sensors may in particular be used for determining and/or adjusting the compaction cycle to be applied to the mixture to be compacted. The sensor measures the force of a single punch and upon the passing of each punch; unlike a stress sensor associated with a compression roller which measures the sum of the forces of the punches in contact with this roller.

Further, these stress sensors may be used for monitoring proper operation of the press and of the punches. In particular, the stress sensors may be used for avoiding any disturbance of the press, notably as regards the positioning of the cam paths (parallelism, relative spacing, etc), and/or by monitoring the compaction at strategic points of the compaction cycle.

It will be noted that the use of stress sensors is independent of the length selected for the compaction-maintaining cam portion 90, so that having such sensors available may be contemplated regardless of the angular section of the compaction-maintaining cam portion 90.

As this was indicated above, the applicant discovered that it may be interesting to form tablets from certain compounds by maintaining them at a constant compaction volume for a determined time, sufficiently long so that the compacted mixture undergoes a particular physical transformation which will significantly improve the properties of the tablet, notably in terms of solidity. For more details on the particular compaction method which may be applied by the press according to the invention, helpfully, reference will be made to the French patent application filed on Jul. 18, 2008 under the number FR 0854909.

The press of the invention may notably be used for compacting powdery compositions comprising at least one powder having elastic properties or thermofusible properties, but also in compacting powdery compositions tending to change state during compaction, for example passing from a solid state to a pasty or liquid state. These may be powdery compositions having high moisture content. By elastic is meant a material which has the property of partly or totally resuming its shape or its volume, after having lost them by compression or extension. By "thermofusible" is meant a material which becomes fluid under the effect of heat.

In an embodiment, the press is used for compacting powdery compositions consisting of a powder or of a mixture of powders, at least one of which has elastic or thermofusible properties.

In a particular embodiment, the press is used for compacting powdery compositions based on plant materials. The compaction may be applied with plant ingredients such as coffee, tea or chicory or plant ingredients capable of making herbal teas such as thyme, rosemary, lime blossom, ginseng, gingko, marjoram, mint, verbena, ginger, wild yam, plants of the rosmarinus officinalis family, and mixtures thereof. The plant compounds applied in the invention generally appear as grains or broken or ground leaves, and having possibly undergone one or more preliminary treatments known per se. The method according to the present invention may in particular be applied to materials such as cellulose, hemicellulose, lignin or any mixture of the previous compounds. The invention may also be applied to wood fiber, algae, tea, aromatic herbs, dry ground plant stems, compost, dried flowers (to be completed with other plant materials).

In another embodiment of the invention, the press is used for compacting compositions for washing laundry of the detergent type. These compositions typically comprise: sequestrants, alkaline agents, bleaching agents, anionic, cationic or non-ionic surfactants (as a liquid, solid supported on zeolites, bentonites or clays in general), bleaching agent activators, enzymes, bursting agents, binders of perfumes, coloring agents, anti foam agents, optical brighteners, anti-color transfer agents (to be completed with main ingredients), the bursting agents of which of the cellulose type (to be completed with elastic ingredients) have elastic properties, binders for example solid polyethylene glycols, solid surfactants of the SDS type, or liquid surfactants supported on bentonite have thermofusible behaviors.

According to still another embodiment of the invention, the presented press is used for compacting compositions for dishwashing.

The presented press allows gradual compaction of initial volume of powder until it reaches a desired compaction volume at which the powder is maintained for a given time. With this, it is possible to obtain a solid compact product from a powdery composition.

Once the mixture has been inserted into the die, the punches are displaced by the compaction cam 9 in order to gradually compact the powdery composition up to the compaction volume which is intended to be maintained constant. The compaction volume is smaller than the initial volume of the non-compacted powdery composition. Moreover, the compaction volume is smaller than or equal to the determined or final volume of the compacted product. Indeed, as this has already been stated, when the powdery composition is particularly elastic, there may be a slight extension of the product upon releasing the constraint on the volume. In an advantageous embodiment, the compaction volume is comprised between 20 and 90% of the initial volume of the powdery composition, and preferentially between 30 and 75% of the initial volume.

With the particular structure of the press, it is possible to maintain the powdery composition at a constant volume which corresponds to the compaction volume for a given time. The time during which a constant compaction volume is maintained is selected depending on the required characteristics for the compacted final tablet. The maintaining time may be determined experimentally.

When the compaction volume is maintained constant, the press and more specifically the punches and the associated compaction cams, are subject to force stresses due to the resistance of the powdery composition. During the compaction step at constant volume, the resistance of the powdery composition gradually decreases, the force stresses on the press therefore decreasing concomitantly.

The measurement of these force stresses during the compaction at constant volume allows determination of the compression curve of a given powdery composition and the minimum time during which the composition should be maintained at the constant compaction volume, may be inferred therefrom. This measurement may be conducted on a laboratory press. The press according to the invention may also be used for conducting this particular measurement, subject to there being a sufficient number of stress sensors laid out in the pressure maintaining cams. In practice, three stress sensors may be used, placed in the compaction-maintaining cam portion 90, respectively at the beginning, at the centre, and at the end of the compaction-maintaining cam portion 90, i.e. at both ends and at the centre of the compaction maintaining cam portion 90. The press according to the invention may also be used for confirming the results of the laboratory, and/or to check whether the behavior of the compacted mixture is similar under industrial conditions.

Once the minimum time for maintaining constant volume is determined, the press should be adjusted so that it is adapted to these compaction conditions, or even the compaction cam 9 should be dimensioned (more specifically the planar compaction-maintaining portion 90) and/or the bearing rollers of the punches.

Examples illustrating the determination of the compression maintaining time are found below as well as of the dimensioning of the corresponding press for different compositions to be compacted.

Example 1

Roasted and ground coffee with an average grain size of 1 mm, and having a 4% loss of volatile materials after dwelling for 20 min at 120° C., is compacted by means of a compacting system with which a controlled constant volume may be reached. The punch used for this compression is a round punch with a diameter of 32 mm with a chamfer. 7 grams of this product are introduced into the confinement chamber representing a filling height of 27.3 mm. The final compression height is set to 8.3 mm leading to a 70% volume reduction. This compression height is maintained for a period of 850 milliseconds. The measured maximum force is 40 kN and only 20 kN after the 850 milliseconds of the maintaining time. We may therefore infer therefrom that it is necessary to ensure a holding time in order to obtain a cohesive tablet. In the present case, the minimum holding time for obtaining a cohesive and transportable tablet is 850 milliseconds. At 850 milliseconds the resulting force is 20 kN. The drop of this holding force is equal to 50%.

The press is therefore dimensioned and/or adjusted so that it may maintain a compaction volume for a period of at least 850 milliseconds, and resist to forces of the order of 40 kN. To do this, a compression cam is used having an angular section of at least 56.1°, for a press having a speed of rotation of 11 revolutions/minute. Further, the punches are preferentially a bearing roller having a diameter of 62 mm, and a width of 56 mm.

Example 2

Roasted and ground coffee with an average grain size of 1 mm and having a 3.3% loss in volatile materials after dwelling for 20 min at 120° C., is compacted with a compacting system with which a controlled constant volume may be reached. The punch used for this compression is a round punch with a diameter of 32 mm with a chamfer. 7 grams of this product are introduced into the confinement chamber representing a filling height of 27.3 mm. The final compression height is set to 8.3 mm leading to a 70% volume reduction. This compression height is maintained for a period of 800 milliseconds. The measured maximum force is 40 kN, and only 20 kN after the 800 milliseconds of holding time. We may therefore infer therefrom that it is necessary to ensure a holding time so as to obtain a cohesive tablet. In the present case, the minimum holding time for obtaining a cohesive and transportable tablet is 400 milliseconds. At 400 milliseconds, the resulting force is 30 kN. The drop of this holding force is equal to 25%.

The press is dimensioned and/or adjusted so that it may maintain a compaction volume for a period of at least 400 milliseconds, and resist forces of the order of 40 kN. To do this, a compression cam is used having an angular section of at least 43.2°, for a press having a speed of rotation of 18 revolutions/minute. Further, the punches preferentially have a bearing roller having a diameter of 62 mm, and a width of 56 mm.

Example 3

A laundry formulation of Eurotab® designated as 30458 is tested in order to check whether it is necessary to maintain a constant volume holding time in order to obtain a cohesive and transportable tablet. The composition to be compacted is indicated in the Table 1 below:

TABLE 1

| composition of the laundry formulation 30458 (Eurotab ®) | |
|---|---|
| COMPOUNDS | % by weight |
| Sequestrants (phosphates, citrate, polymers, zeolite . . .) | 35-50% |
| Alkaline agents (sodium silicate, carbonate . . .) | 10-30% |
| Filler (sodium bicarbonate, sulphate . . .) | 3-20% |
| Non-ionic and anionic surfactants | 10-18% |
| Enzymes | 0.5-3% |
| Bleaching agents and activator | 10-20% |
| Binder (polyethylene glycol powder . . .) | 1-5% |
| Disintegrating agents (cellulose . . .) | 2-8% |
| Optical brightener | 0-1% |
| Antifoam agent | 0-1% |
| Perfume | 0.5%-1% |
| Coloring agent | 0.05%-0.1% |

For this test, a round punch with a diameter of 45 mm with a chamfer, a standard punch for the laundry tablet application, is used. 40 grams of this 30458 formulation are introduced into the compaction chamber representing a filling height of 38 mm. The final compression height is set to 18 mm leading to a 53% reduction. This compression height is maintained for a period of 800 milliseconds. The measured maximum force is 31.5 kN, and only 18 kN after the 800 milliseconds of the holding time. We may therefore infer therefrom that it is necessary to ensure a holding time in order to obtain a cohesive tablet. In the present case, the minimum holding time for obtaining a cohesive and transportable tablet is 100 milliseconds. At 112 milliseconds, the resulting force is 28 kN. The drop in this holding force is equal to 11%.

The press is dimensioned and/or adjusted so that it may maintain a compaction volume for a period of at least 100 milliseconds, and resist forces of the order of 32 kN. To do this, a compression cam is used having an angular section of at least 10.8°, for a press having a speed of rotation of 18 revolutions/minute. Further, the punches preferentially have a bearing roller having a diameter of 62 mm and a width of 56 mm.

Example 4

ARBOCEL™ TF415 (cellulose), marketed by Rettenmaier®, is tested in order to check whether it is necessary to maintain a constant volume holding period in order to obtain a cohesive and transportable tablet. For this test, a round punch with a diameter of 32 mm with a chamfer is used. 8.45 grams of this ARBOCEL™ TF415 are introduced into the compaction chamber representing a filling height of 28 mm. The final compression height is set to 9 mm leading to a 68% volume reduction. This compression height is maintained for a period of de 800 milliseconds. The measured maximum force is 21 kN, and only 8 kN after 800 milliseconds of holding time. We may therefore infer therefrom that it is necessary to ensure a holding time in order to obtain a cohesive tablet. In the present case, the minimum holding time for obtaining a cohesive and transportable tablet is 300 milliseconds. At 300 milliseconds, the resulting force is 18 kN. The drop of this holding force is equal to 14.3%.

The press is therefore dimensioned and/or adjusted so that it may maintain a compaction volume for a period of at least 300 milliseconds, and withstand forces of the order of 21 kN. To do this, a compression cam is used having an angular section of at least 19.8°, for a press having a speed of rotation of 11 revolutions/minute. Further, the punches preferentially have a bearing roller having a diameter of 62 mm, and a width of 56 mm.

The fact of using a planar cam for maintaining compaction is particularly advantageous so that the press has significant production rates. Indeed, the use of the planar cam for maintaining compaction enables compaction to be maintained for a relatively long time, for example, of the order of 800 ms, or even 2,500 ms, without however reducing the rate of formation of tablets by the press. Indeed, the use of holding cams implies that several punches are simultaneously on the cam path, and therefore many tablets may be simultaneously compacted on the same planar cam portion, with only a slight shift in the compaction cycle.

Table 2 below illustrates the minimum angular sections of the planar cam portion, for different times for maintaining compaction at constant volume, and for different speeds of rotation of the press. These values are of course not a limitation and the section of the planar cam portion will be adapted depending on the desired period for maintaining constant volume compaction; the angular section of the planar cam portion may therefore be comprised between these values or be greater, for a given speed of rotation. The logic is identical if the speed of rotation of the press is changed.

TABLE 2

Examples of angular sections for the planar cam portion for different holding times and different speeds of rotation of the press.

| Speed of rotation of the press (in rpm) | Angular section of the planar cam portion (in degrees) versus the compaction-maintaining time (in ms) | | | | | | | | | | | |
|---|---|---|---|---|---|---|---|---|---|---|---|---|
| | 30 ms | 100 ms | 300 ms | 400 ms | 750 ms | 800 ms | 850 ms | 1000 ms | 1500 ms | 2000 ms | 2500 ms | 3000 ms |
| 2 | 0.4° | 1.2° | 3.6° | 4.8° | 9.0° | 9.6° | 10.2° | 12.0° | 18.0° | 24.0° | 30.0° | 36.0° |
| 5 | 0.9° | 3.0° | 9.0° | 12.0° | 22.5° | 24.0° | 25.5° | 30.0° | 45.0° | 60.0° | 75.0° | 90.0° |
| 8 | 1.4° | 4.8° | 14.4° | 19.2° | 36.0° | 38.4° | 40.8° | 48.0° | 72.0° | 96.0° | 120.0° | 144.0° |
| 10 | 1.8° | 6.0° | 18.0° | 24.0° | 45.0° | 48.0° | 51.0° | 60.0° | 90.0° | 120.0° | 150.0° | 180.0° |
| 11 | 2.0° | 6.6° | 19.8° | 26.4° | 49.5° | 52.8° | 56.1° | 66.0° | 99.0° | 132.0° | 165.0° | 198.0° |
| 15 | 2.7° | 9.0° | 27.0° | 36.0° | 67.5° | 72.0° | 76.5° | 90.0° | 135.0° | 180.0° | 225.0° | 270.0° |
| 18 | 3.2° | 10.8° | 32.4° | 43.2° | 81.0° | 86.4° | 91.8° | 108.0° | 162.0° | 216.0° | 270.0° | 324.0° |
| 20 | 3.6° | 12.0° | 36.0° | 48.0° | 90.0° | 96.0° | 102.0° | 120.0° | 180.0° | 240.0° | 300.0° | 360.0° |
| 25 | 4.5° | 15.0° | 45.0° | 60.0° | 112.5° | 120.0° | 127.5° | 150.0° | 225.0° | 300.0° | — | — |
| 30 | 5.4° | 18.0° | 54.0° | 72.0° | 135.0° | 144.0° | 153.0° | 180.0° | 270.0° | 360.0° | — | — |
| 35 | 6.3° | 21.0° | 63.0° | 84.0° | 157.5° | 168.0° | 178.5° | 210.0° | 315.0° | — | — | — |
| 40 | 7.2° | 24.0° | 72.0° | 96.0° | 180.0° | 192.0° | 204.0° | 240.0° | 360.0° | — | — | — |
| 45 | 8.1° | 27.0° | 81.0° | 108.0° | 202.5° | 216.0° | 229.5° | 270.0° | — | — | — | — |
| 50 | 9.0° | 30.0° | 90.0° | 120.0° | 225.0° | 240.0° | 255.0° | 300.0° | — | — | — | — |

The dimensioning of the press and of the associated planar cam portion depends on particular industrial constraints for making the tablets with the desired volume.

For example, it may be decided to make a press with two outlets (i.e. two tablets per revolution are formed for a same die/punches assembly) so that the planar cam portion should have an angular section necessarily below 180°, preferentially below 170°. The speed of rotation of the press is then adjusted depending on the selected angular section for the planar cam portion in order to have the desired time for maintaining constant volume compaction.

The dimensioning of the planar cam portion may also be imposed by the operating constraints of the press (limiting speeds of rotation). Thus, for a standard production press having a speed of rotation comprised between 18 and 30 revolutions/minute, a planar cam portion is used having an angular section greater than 3° and 5° respectively, and preferably greater than 10° and 18° respectively.

If speeds of rotation of the press comprised between 18 and 30 revolutions/minute are generally preferred for ensuring a good rate, it may be necessary to reduce this speed of rotation depending on the composition of the mixture to be compacted, on its behavior during compaction. Thus, it is not seldom that the speed of rotation of the press be set around about 10 revolutions/minute. In order to maintain an acceptable industrial rate, it is all the same preferable if the press rotates at a speed at least equal to 5 revolutions/minute, and preferably at a speed greater than 8 revolutions/minute.

Preferably, a planar cam portion is used having an angular section comprised between 5° and 170° which allows compaction of the mixtures during compaction-maintaining times comprised between 100 and 2,500 milliseconds, and this according to a wide range of speeds of rotation of the press with which a good industrial rate may be ensured. The fact of being able to compact according to various speeds of rotation gives the possibility of compacting any type of mixture during the indicated compaction times (between 100 and 2,500 milliseconds), including mixtures requiring a reduced speed of rotation of the press (of the order of about 10 revolutions/minute). Further, productivity is all the better since such an angular section for the planar cam portion moreover allows having a press comprising at least two outlets.

Still preferably, a planar cam portion is used having an angular section comprising 35° and 90°. Such a planar cam indeed allows compaction of mixtures during compaction maintaining times of the order of 800 ms (plus or minus 50 ms) at high speeds of rotation of the press. With this, it is indeed possible to operate at speeds comprised between 8 and 18 revolutions/minutes, thereby providing the possibility of compacting mixtures of various compositions. Moreover, this also allows an increase in the number of outlets, placing at least three of them if this is desired.

As an illustration of these advantages in terms of productivity, a press with planar cam portions for maintaining compaction having an angular section of about 52°, allows configuration of the press so that it has two outlets, with about fifty pairs of punches circulating at the same time in the press, which allows a production of nearly 1,100 coffee tablets per minute (with a speed of rotation of 11 revolutions/minute, for a compaction-maintaining time of about 800 ms).

The reader will have understood that many modifications may be made without practically departing from the novel teachings and advantages described herein. Therefore, all the modifications of this type are intended to be incorporated within the scope of the press device according to the invention.

The invention claimed is:

1. A press device for manufacturing tablets from a mixture of at least one component, comprising:

a turntable (1) in which is arranged at least one die (2) for receiving the mixture, at least one compaction assembly comprising a first punch (3) and a second punch (4), said first and second punches being laid out on either side of the turntable (1) facing the die (2), and being mounted so as to be translationally mobile coaxially with the die (2), first control means (7) and second control means (8) for controlling axial displacement of the first punch (3) and of the second punch (4) respectively, said first (7) and second (8) control means comprising means co-operating for maintaining the first (3) and second (4) punches in a fixed axial position in which the first (3) and second (4) punches define a confinement volume (V) with the die (2), wherein the first control means (7) comprise a compaction cam (9) for displacing the first punch (3) into a compaction position, said compaction cam (9) comprising a cam path on which said first punch (3) is capable of being displaced, the cam path comprising a planar portion (90) substantially perpendicular to the axis of the first punch (3), the planar portion (90) extending over an angular section comprised between 5° and 170° for maintaining the first punch (3) in the die (2) at a fixed compaction axial position during a determined compaction-maintaining time, the second control means (8) also comprising means for maintaining the second punch in said die at a fixed compaction axial position at least during said compaction-maintaining time, so as to maintain, during said compaction-maintaining time, the confinement volume (V) at a constant volume corresponding to a compaction volume for forming the tablet, and wherein the compaction cam (9) comprises three stress sensors (C1;C2;C3) distributed in three cavities made in the compaction cam (9) for measuring stresses undergone by the cam path upon passing of the first punch (3), said three cavities being formed at a center and at two ends of the planar portion (90) of the cam path, respectively.

2. The device of claim 1, wherein the planar portion (90) of the cam path extends over an angular section comprised between 35° and 90°.

3. The device of claim 1, wherein the cam path of the compaction cam (9) further comprises a pressure rising portion (91) located upstream from the planar portion (90), the pressure rising portion (91) being adapted so as to axially displace the first punch (3) in the direction of insertion of the first punch (3) into the die (2), towards the axial compaction-maintaining position.

4. The device of claim 1, wherein the cam path of the compaction cam further comprises a pressure lowering portion located downstream from the planar portion (90), the pressure lowering portion being adapted for axially displacing the first punch (3) in a direction of withdrawal of the first punch (3) of the die (2), from the axial compaction-maintaining position.

5. The device of claim 1, wherein the first punch (3) comprises at least one bearing roller (33) laid out so as to allow both rolling of the first punch (3) on the cam path of the compaction cam (9) according to a direction of rotation of the turntable (1) and an axial displacement of said first punch (3).

6. The device of claim 5, wherein the bearing roller (33) is laid out at one end of the first punch (3) coaxially with the axis of said first punch (3), with a radial axis of rotation relatively to said first punch (3).

7. The device of claim 1, wherein the first punch (3) further comprises a guiding member (34) extending radially relatively to said first punch (3), the first control means (7) comprising at least one guide rail (12) provided with a groove arranged for receiving said guiding member (34).

8. The device of claim 7, wherein the guiding member (34) comprises two rollers (34) laid out on each side of one end of the first punch (3) so as to be able to roll in the grooves laid out on either side of a circular trajectory defined by a displacement of the die (2).

9. The device of claim 1, wherein the second control means (8) have a configuration identical with the first control means (7).

10. The device of claim 1, wherein the second punch (4) has a configuration identical with the first punch (3).

11. The device of claim 1, wherein the first punch (3) and the second punch (4) respectively correspond to the lower punch (3) and to the upper punch (4) of the press, the first (7) and second (8) control means corresponding to the lower (7) and upper (8) control means, respectively.

* * * * *